US006121936A

United States Patent [19]

Hemming et al.

[11] Patent Number: 6,121,936

[45] Date of Patent: Sep. 19, 2000

[54] CONFORMABLE, INTEGRATED ANTENNA STRUCTURE PROVIDING MULTIPLE RADIATING APERTURES

[75] Inventors: Leland H. Hemming, Mesa; Micheal A. Kovalchik, Queen Creek; Donald T. Johnson, Mesa, all of Ariz.

[73] Assignee: McDonnell Douglas Corporation, St. Louis, Mo.

[21] Appl. No.: 09/170,657

[22] Filed: Oct. 13, 1998

[51] Int. Cl.[7] ..... H01Q 1/36

[52] U.S. Cl. ..... 343/769; 343/725; 343/770; 343/895; 343/789

[58] Field of Search ..... 343/727, 725, 343/895, 769, 770, 789; H01Q 1/36

[56] References Cited

U.S. PATENT DOCUMENTS

| | | | |
|---|---|---|---|
| 2,908,904 | 10/1959 | Van Atta et al. . | |
| 3,016,534 | 1/1962 | D'Agostino et al. . | |
| 3,569,971 | 3/1971 | Griffee . | |
| 4,015,264 | 3/1977 | Koerner . | |
| 4,032,921 | 6/1977 | Sikina et al. | 343/895 |
| 4,245,222 | 1/1981 | Eng et al. . | |
| 4,297,707 | 10/1981 | Brunner et al. . | |
| 4,329,690 | 5/1982 | Parker . | |
| 4,329,692 | 5/1982 | Brunner . | |
| 4,400,701 | 8/1983 | Dupressoir . | |
| 4,431,996 | 2/1984 | Milligan . | |
| 4,590,480 | 5/1986 | Nikolayuk et al. . | |
| 4,635,066 | 1/1987 | St. Clair et al. . | |
| 4,833,485 | 5/1989 | Morgan . | |
| 5,057,848 | 10/1991 | Rankin et al. . | |
| 5,160,936 | 11/1992 | Braun et al. . | |
| 5,223,849 | 6/1993 | Kasevich et al. | 343/895 |
| 5,262,791 | 11/1993 | Tsuda et al. . | |
| 5,461,392 | 10/1995 | Mott et al. . | |
| 5,463,406 | 10/1995 | Vannatta et al. . | |
| 5,608,413 | 3/1997 | Macdonald . | |
| 5,610,620 | 3/1997 | Stites et al. . | |
| 5,650,792 | 7/1997 | Moore et al. . | |
| 5,726,664 | 3/1998 | Park et al. . | |

*Primary Examiner*—Michael C. Wimer
*Attorney, Agent, or Firm*—Alston & Bird LLP

[57] ABSTRACT

A conformable, integrated antenna assembly providing three or more radiating apertures in a single antenna structure is provided. The antenna assembly is adapted to mount flush with the fuselage or other surface of an aircraft or other structure. A range of antenna services, including communications, navigation and IFF (CNI) services, may thus be provided while simultaneously minimizing aerodynamic drag and reducing size, weight and cost.

21 Claims, 1 Drawing Sheet

CONFORMABLE, INTEGRATED ANTENNA STRUCTURE PROVIDING MULTIPLE RADIATING APERTURES

FIELD OF THE INVENTION

The present invention relates to the design of antenna structures for radiating radio frequency energy, and particularly to the design of antenna structures comprising multiple antenna elements for providing multiple communications, navigation and IFF (identify: friend or foe) functions with a single antenna structure wherein such antenna structure is desirably conformable to a surface of an aircraft, missile or other structure.

BACKGROUND OF THE INVENTION

For aircraft, missiles and other platforms, there is frequently a need to provide communications, navigation, IFF (collectively, "CNI"), and other services through antennas that may be flush-mounted to the surface of the platform for aerodynamic and other reasons. A number of antenna structures have been employed to provide the necessary antenna gain over a broad range of frequency, polarization, and beam shape requirements in a form factor suitable for flush mounting.

Of these antenna structures, a planar spiral antenna has two outwardly-spiraling branches lying in the same plane that are symmetrical with respect to a point at the center of the antenna. To produce maximum radiation in two directions that are mutually symmetrical about the plane of the spirals, the two branches are fed out of phase with each other. Each of the two spirals may be terminated resistively at the outward ends of the spirals.

To maximize radiation in a single direction from a spiral antenna, the spirals may be backed by a coaxial cavity extending to the outer edge of the spirals and having a depth equal to about one-half wavelength at the center operating frequency of the antenna. The back surface of the cavity reflects the radiation directed in the back direction so as to reinforce the radiation in the forward direction over a limited frequency range.

Another common type of antenna is an annular slot antenna which comprises an annular slot cut in a metallic surface. A simple annular slot antenna may be formed by terminating a coaxial line to a ground plane such that the coaxial line is open-circuited at the termination. In other words, the coaxial line's center conductor terminates in the circular conducting disk inside the annular slot and the coaxial line's outer conductor or shield terminates in the ground plane outside the annular slot.

A truncated annular slot antenna may be constructed by dividing the annular slot into slot sections which together approximate a full annular slot. For example, the ground plane outside the annular slot may be extended to meet the circular conducting disk inside the annular slot with symmetrical thin fingers of the ground plane. Feeding each of the truncated slots formed thereby in phase and with equal amplitude will approximate the excitation of a full annular slot by a coaxial line.

Because a range of diverse CNI services must be provided on modern aircraft, missiles, and other platforms, requirements for several frequencies, polarizations, and beam shapes are often presented to the antenna suite designer. Unfortunately, conventional antenna suite designs typically employ individual antennas to meet each antenna requirement and do not structurally integrate the antenna suite in a conformal package to thereby minimize space, cost and weight and reduce aerodynamic drag.

Known attempts to provide multiple antenna functions in a single antenna aperture or to structurally integrate an antenna suite have met with limited success. For example, U.S. Pat. No. 5,160,936 to Braun et al. ("Braun") discloses a lightweight phased array antenna system that is conformable to an aircraft fuselage and that combines air-filled cavity-backed slots with printed circuit elements for operation in two or more frequency bands. In Braun, the printed circuit elements are separated from a conductive ground plane in which the slots are cut by a dielectric honeycomb material. The slots and printed circuit elements are individually excitable by a multiband feed network and transmit/receive modules for operation in the UHF band and S band or L band, respectively.

An attempt at structural integration of several antenna apertures is disclosed in U.S. Pat. No. 5,650,792 to Moore et al. ("Moore"). Moore discloses a monopole VHF antenna and a volute GPS antenna housed in a base shell similar to that of a single VHF whip-type antenna. A further attempt at structural integration of several apertures is disclosed in U.S. Pat. No. 4,329,690 to Parker ("Parker"). Parker discloses a multiple antenna system for a ship mast top with the individual antenna sections being in stacked relationship. The separate GPS, TACAN and JTIDS antennas are isolated by decoupling chokes to permit each antenna to rotate about the mast freely. Additionally, a primary radar antenna integrated with an IFF antenna and particularly suitable as a combined primary radar/IFF antenna for smaller vehicles is disclosed by U.S. Pat. No. 4,329,692 to Brunner.

While a number of antenna designs have been developed in an attempt to provide multiple antenna functions in a structurally integrated antenna suite, none of these antenna designs have provided the combination of functionality and structure demanded by some current applications. For example, none of the conventional designs provide the three or more radiating apertures required for CNI services in a conformal geometry.

SUMMARY OF THE INVENTION

It is an object of the present invention to provide a single antenna structure with multiple antenna elements for providing multiple communications, navigation and IFF functions.

It is a further object of the present invention to provide a multi-function antenna assembly that is conformable to a surface of an aircraft so that aerodynamic drag and radar scattering are minimized and size, weight and cost are reduced.

These and other objects are provided, according to the present invention, by a multi-function antenna assembly, for receiving and transmitting a plurality of RF signals, comprising a support structure and at least three antennas mounted to the support structure. The first antenna comprises a first spiral antenna structure, the second antenna comprises an annular slot antenna structure disposed about the center of the first spiral antenna structure, and the third antenna comprises a second spiral antenna structure disposed within the center of the annular slot antenna structure. According to the invention, the first spiral antenna structure, the annular slot antenna structure, and the second spiral antenna structure are substantially coplanar. The multi-function antenna assembly thus provides multiple communications, navigation, and/or IFF functions with a single antenna structure conformable to an aircraft fuselage or other mounting surface. A range of antenna services is thus provided while minimizing aerodynamic drag and radar scattering.

In one embodiment of the invention, the first antenna is adapted to operate at UHF frequencies and further comprises a first housing with a first dielectric-filled cavity disposed behind the first spiral antenna structure and two shielded stripline transformers for feeding the first spiral antenna structure. In this embodiment, the second antenna is adapted to operate at L-band frequencies and further comprises a second housing defining a second cavity disposed behind the annular slot antenna structure and a microstrip feed network for feeding the annular slot antenna structure. In addition, the third antenna of this embodiment is adapted to operate at GPS frequencies and further comprises a microstrip balun for feeding the second spiral antenna structure. The support structure of the multi-function antenna assembly can also include a flange for mounting the antenna assembly to a mounting structure in a manner such that the antenna assembly has a conformal geometry. As such, UHF and L-band communications and GPS services may be provided by a single integrated, conformal antenna assembly according to this embodiment of the present invention.

The multi-function antenna assembly of the present invention therefore overcomes limitations imposed by conventional multi-function antenna assemblies. In particular, a conformable, integrated antenna structure having three or more radiating apertures is provided in a design having a conformal geometry. A range of antenna services are thus provided while minimizing aerodynamic drag and radar scattering and reducing size, weight and cost.

DETAILED DESCRIPTION OF THE INVENTION

The present invention will now be described more fully with reference to the accompanying drawings, in which preferred embodiments of the invention are shown. This invention may, however, be embodied in many different forms and should not be construed as limited to the embodiments set forth here; rather, these embodiments are provided so that this disclosure will be thorough and complete and will fully convey the scope of the invention to those skilled in the art. Like numbers refer to like elements throughout.

Figure 1:
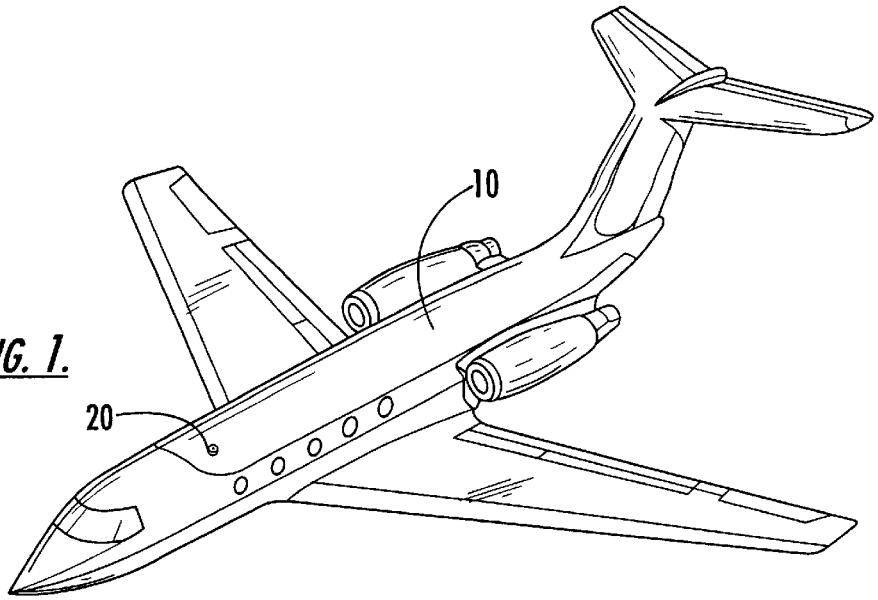
FIG. 1 is a perspective view of an aircraft and aircraft fuselage on which a multi-function antenna assembly of one embodiment of the present invention has been installed.

The antenna assembly 20 of the present invention is shown mounted on the fuselage of aircraft 10 in FIG. 1, though the antenna assembly could be mounted on other surfaces of aircraft 10 or on a missile or other vehicle or structure. The antenna assembly 20 is preferably conformally mounted to a relatively flat surface of the fuselage of aircraft 10 so as not to substantially degrade the aerodynamic performance of aircraft 10. The location of antenna assembly 20 on aircraft 10 is preferably selected based on the field of view requirements of the individual antennas within the antenna assembly, which are in turn driven by the functions that the antenna assembly is designed to perform. For example, the antenna assembly is generally mounted to the upper portion of the aircraft so as to provide a field of view oriented in the upper hemisphere relative to the aircraft.

Antenna assembly 20 is preferably mounted to aircraft 10 by means of a mounting flange 30 disposed about the periphery of the antenna assembly. For example, the mounting flange can be attached to the surrounding portions of the aircraft by means of camlock fasteners. As known to those skilled in the art, the antenna assembly 20 communicates with other onboard electrical components in order to process, display and store the data collected by the antenna assembly. In this regard, radio frequency input and output signals are preferably provided to the antenna assembly by means of RF transmission lines, such as coaxial cables, or by other RF distribution means.

Figure 2:
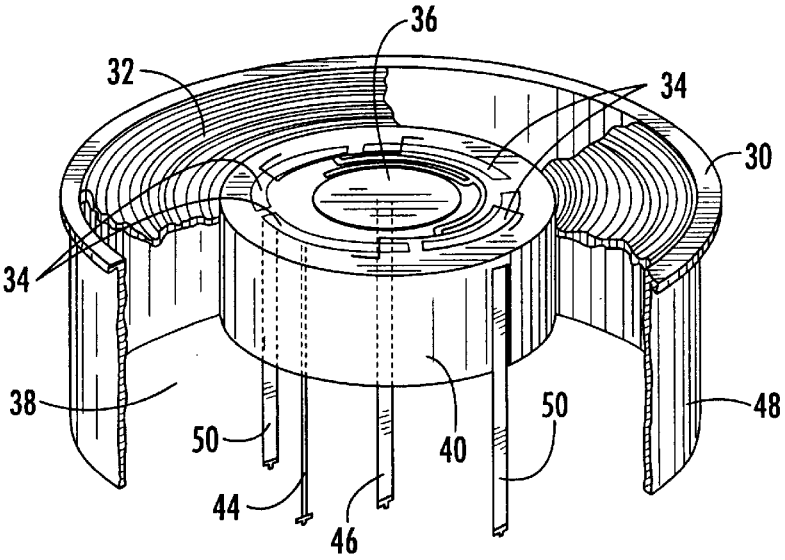
FIG. 2 is a perspective view of the multi-function antenna assembly of one embodiment of the present invention.

A perspective view of one embodiment of the present invention is provided in FIG. 2. In this embodiment, a UHF spiral antenna 32, an L-band slot antenna 34, and a GPS spiral antenna 36 are all provided in antenna assembly 20.

UHF spiral antenna 32 is a substantially planar spiral element comprising two center-fed symmetrical spirals each terminating in a resistive load, such as a resistive coating, at the periphery. A UHF cavity 38 is preferably formed behind the UHF spiral antenna 32 at a depth of one-half wavelength at mid-band (about ten inches if the UHF spiral antenna is designed to operate over the 225 MHz to 400 MHz frequency band) so as to reinforce a radiation pattern in an outward direction away from aircraft 10. In one embodiment, the two spirals are fed out of phase and the pattern thus formed is a circularly polarized unidirectional lobe perpendicular to the face of antenna assembly 20. UHF spiral antenna 32 is preferably fed by two shielded stripline transformers 50. A microstrip 180 degree hybrid network can be used to provide the 0/180 degree feed for the UHF signal input.

In one preferred embodiment, the outer diameter of UHF spiral antenna 32 is 22 inches and the inner diameter is nine inches. In this embodiment, the spiral element windings are 0.170 inches wide with 0.070 inch gaps between windings. The winding dimensions in this embodiment are selected to lower the characteristic impedance of the windings so as to aid in impedance matching the windings to the shielded feed lines. Radar scattering is also reduced, relative to a more conventional winding design where winding gaps are equal to winding widths. The outer two windings of UHF spiral antenna 32 are coated with a 100 ohm/square coating to terminate the windings and reduce the VSWR presented to the input connector.

UHF cavity 38 may be filled with a low-dielectric hardened foam, such as 23 lb./ft$^3$ syntactic foam with a dielectric constant of 1.52, to add to the structural integrity of antenna assembly 20. Alternatively, UHF cavity 38 may be filled with a high-dielectric foam and the depth of UHF cavity 38 may be reduced accordingly.

Figure 3:
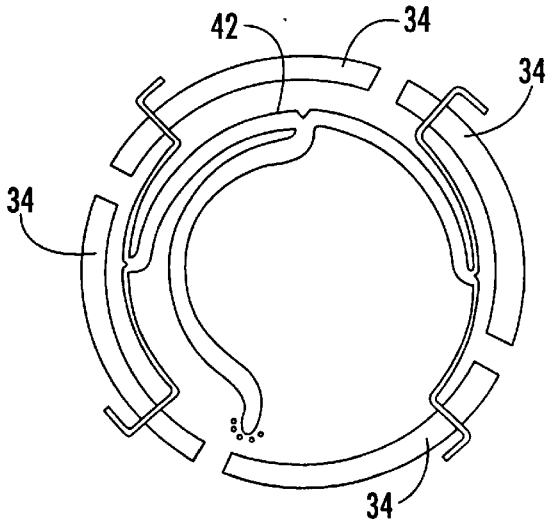
FIG. 3 is a plan view of an L-band slot antenna microstrip feed network according to one aspect of the present invention.

L-band slot antenna 34 is preferably an annular slot antenna formed about the center of UHF spiral antenna 32. In one embodiment, L-band slot antenna 34 comprises four equal-sized slots having length 4.5 inches and width 0.5 inches disposed symmetrically at a radius of 3.25 inches within UHF spiral antenna 32. However, the L-band slot antenna can have other numbers of slots without departing from the spirit and scope of the present invention. L-band slot antenna 34 is preferably backed by L-band cavity 40, which is preferably filled with foam having a dielectric constant of 1.52, to reinforce energy radiated in a direction outward away from aircraft 10. In one embodiment, L-band slot antenna 34 operates over the 960 MHz to 1225 MHz frequency band and the depth of L-band cavity 40 is about three inches. Although the L-band slot antenna 34 can be fed in different manners, L-band slot antenna 34 is preferably fed by a microstrip feed network 42, as is shown in FIG. 3. In one preferred embodiment, microstrip feed network 42 feeds four slots in phase and with equal amplitude and the radiation pattern is vertically polarized and uniform in the horizontal plane (relative to aircraft 10). In this embodiment, microstrip feed network 42 is connected to a coaxial line 44 which runs from the L-Band network to the bottom of UHF cavity 38.

As also illustrated, GPS spiral antenna 36 is a spiral element comprising two center-fed symmetrical spirals each terminating in a resistive load, such as a resistive coating. GPS spiral antenna 36 is disposed within the center of L-band slot antenna 34 and is preferably fed by microstrip balun 46, though the GPS spiral antenna can be fed in other manners without departing from the spirit and scope of the present invention. In a preferred embodiment, the radiation pattern formed by GPS spiral antenna 36 is circularly polarized and unidirectional perpendicular to the face of antenna assembly 20. In one embodiment, GPS spiral antenna 36 operates over the 1.2 GHz to 1.6 GHz band. In this embodiment, GPS spiral antenna 36 has an outer diameter of 3.43 inches and an inner diameter of 0.030 inches at the feed point. The windings of GPS spiral antenna 36 in this embodiment are 0.050 inches wide with 0.010 inch gaps between windings.

The support structure of antenna assembly 20 is preferably a substantially planar substrate formed of a 0.062 inch thick Teflon-glass microwave printed circuit board which preferably serves as one surface of housing 48 upon which UHF spiral antenna 32, L-band slot antenna 34, and GPS spiral antenna 36 are all formed. Housing 48 preferably includes a mounting flange 30 one inch wide about the periphery of antenna assembly 20 to conformally mount the assembly on the fuselage of aircraft 10, such as by means of camlock fasteners. RF feed signals to and from UHF spiral antenna 32, L-band slot antenna 34, and GPS spiral antenna 36 are preferably provided via coaxial cables from inside aircraft 10.

Antenna assembly 20 may be covered with a magnetically loaded cover, the RF properties of which have been chosen, as is known in the art, to absorb incident microwave energy without substantially degrading the performance of the UHF spiral antenna 32, L-band slot antenna 34, and GPS spiral antenna 36. For example, the magnetically loaded cover may be constructed from a material such as Carbonyl iron powder (0.44 volume load) polyurethane elastomer. The microwave frequency scattering of aircraft 10 from antenna assembly 20 may thereby be minimized.

In one preferred embodiment, the magnetically loaded cover is installed or deposited on the face of antenna assembly 20 and comprises a thin sheet of dielectric material, such as Teflon-glass, with a thickness of approximately 0.030 inches on which a thin sheet of magnetic radar absorbing material ("magram") with a thickness of approximately 0.040 inches has been installed or deposited. For example, the magram material may consist of magnetic iron particles embedded within a binder such as urethane or silicone. The magram thickness may be chosen to absorb energy at different radar frequencies. For example, magram having a thickness of 0.40 inches preferably absorbs energy at the higher microwave frequencies. In addition, the dielectric material spaces the magram away from the metallic antenna elements to minimize antenna circuit losses.

The multi-function antenna assembly 20 of the present invention therefore overcomes limitations imposed by conventional multi-function antenna assemblies. In particular, a conformable, integrated antenna structure providing three or more radiating apertures is provided. A range of antenna services is thus provided while minimizing aerodynamic drag and radar scattering and reducing size, weight and cost.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A multi-function antenna assembly, for receiving and transmitting a plurality of RF signals, comprising:

a support structure;

a first antenna mounted to said support structure, said first antenna comprising a first spiral antenna structure and two shielded stripline transformers for feeding said first spiral antenna structure;

a second antenna mounted to said support structure, said second antenna comprising an annular slot antenna structure disposed about a center of said first spiral antenna structure and a microstrip feed network for feeding said annular slot antenna structure; and a third antenna mounted to said support structure, said third antenna comprising a second spiral antenna structure disposed within a center of said annular slot antenna structure and a microstrip balun for feeding said second spiral antenna structure;

wherein said first spiral antenna structure, said annular slot antenna structure, and said second spiral antenna structure are substantially coplanar.

2. The multi-function antenna assembly of claim 1 wherein said first antenna further comprises a first housing defining a first cavity disposed adjacent said first spiral antenna structure.

3. The multi-function antenna assembly of claim 2 wherein said first cavity is filled with a dielectric material.

4. The multi-function antenna assembly of claim 1 wherein said second antenna further comprises a second housing defining a second cavity disposed adjacent said annular slot antenna structure.

5. The multi-function antenna assembly of claim 1 wherein said support structure comprises a flange for mounting the multi-function antenna assembly to a mounting structure.

6. The multi-function antenna assembly of claim 1 wherein said annular slot antenna structure defines four slots.

7. The multi-function antenna assembly of claim 1 wherein said first antenna is adapted to operate at UHF frequencies.

8. The multi-function antenna assembly of claim 1 wherein said second antenna is adapted to operate at L-band frequencies.

9. The multi-function antenna assembly of claim 1 wherein said third antenna is adapted to operate at GPS frequencies.

10. The multi-function antenna assembly of claim 1 wherein said support structure comprises a magnetically loaded cover for reducing microwave frequency scattering of the multi-function antenna assembly.

11. The multi-function antenna assembly of claim 1:

wherein said first antenna is adapted to operate at UHF frequencies and further comprises:

a first housing defining a first cavity disposed adjacent said first spiral antenna structure and filled with a dielectric material;

wherein said second antenna is adapted to operate at L-band frequencies and further comprises:

a second housing defining a second cavity disposed adjacent said annular slot antenna structure;

wherein said annular slot antenna structure defines four slots;

wherein said third antenna is adapted to operate at GPS frequencies; and wherein said support structure comprises a flange for mounting the multi-function antenna assembly to a mounting structure.

12. A communications, navigation, and IFF (identify friend or foe) radio (CNI) antenna structure, for both receiving and transmitting signals to provide communication, navigation and IFF services, comprising:

a substrate;

a first spiral antenna formed on said substrate;

two shielded stripline transformers for feeding said first spiral antenna;

an annular slot antenna formed on said substrate, said annular slot antenna disposed about a center of said first spiral antenna;

a microstrip feed network for feeding said annular slot antenna;

a second spiral antenna formed on said substrate, said second spiral antenna disposed within a center of said annular slot antenna; and a microstrip balun for feeding said second spiral antenna.

13. The CNI antenna structure of claim 12 further comprising a first housing mounted to said substrate and defining a first cavity disposed adjacent said first spiral antenna.

14. The CNI antenna structure of claim 13 wherein said first cavity is filled with a dielectric material.

15. The CNI antenna structure of claim 12 further comprising a second housing mounted to said substrate and defining a second cavity disposed adjacent said annular slot antenna.

16. The CNI antenna structure of claim 12 wherein said substrate comprises a flange for mounting the CNI antenna structure to a mounting structure.

17. The CNI antenna structure of claim 12 wherein said annular slot antenna defines four slots.

18. The CNI antenna structure of claim 12 wherein said first spiral antenna is adapted to operate at UHF frequencies.

19. The CNI antenna structure of claim 12 wherein said annular slot antenna is adapted to operate at L-band frequencies.

20. The CNI antenna structure of claim 12 wherein said second spiral antenna is adapted to operate at GPS frequencies.

21. The CNI antenna structure of claim 12 further comprising a magnetically loaded cover for reducing microwave frequency scattering of the CNI antenna structure.

* * * * *